US008264304B2

(12) United States Patent
Boisbouvier et al.

(10) Patent No.: US 8,264,304 B2
(45) Date of Patent: Sep. 11, 2012

(54) SLOT-LINE TYPE MICROWAVE DEVICE WITH A PHOTONIC BAND GAP STRUCTURE

(75) Inventors: Nicolas Boisbouvier, Evian les Bains (FR); Ali Louzir, Rennes (FR); Françoise Le Bolzer, Rennes (FR); Anne-Claude Tarot, Etrelles (FR); Kouroch Mahdjoubi, Cesson Sevigne (FR)

(73) Assignee: Thomson Licensing, Issy-les-Moulineaux (FR)

( * ) Notice: Subject to any disclaimer, the term of this patent is extended or adjusted under 35 U.S.C. 154(b) by 1162 days.

(21) Appl. No.: 10/585,489

(22) PCT Filed: Jan. 3, 2005

(86) PCT No.: PCT/FR2005/050001

§ 371 (c)(1),
(2), (4) Date: Oct. 23, 2009

(87) PCT Pub. No.: WO2005/067094

PCT Pub. Date: Jul. 21, 2005

(65) Prior Publication Data

US 2010/0039190 A1 Feb. 18, 2010

(30) Foreign Application Priority Data

Jan. 7, 2004 (FR) ..... 04 50036

(51) Int. Cl.
*H01P 1/201* (2006.01)

(52) U.S. Cl. ..... 333/204; 343/767

(58) Field of Classification Search ..... 333/204, 333/219; 343/767, 909
See application file for complete search history.

(56) References Cited

U.S. PATENT DOCUMENTS

| | | | | |
|---|---|---|---|---|
| 5,489,881 | A * | 2/1996 | Yuda et al. | 333/203 |
| 6,304,220 | B1 * | 10/2001 | Herve et al. | 343/700 MS |
| 6,411,181 | B1 * | 6/2002 | Ishikawa et al. | 333/219 |
| 6,661,315 | B2 * | 12/2003 | Iio | 333/219 |
| 7,277,065 | B2 * | 10/2007 | Wu et al. | 343/909 |
| 7,355,554 | B2 * | 4/2008 | Boisbouvier et al. | 343/767 |
| 2001/0050641 | A1 * | 12/2001 | Itoh et al. | 343/700 MS |

OTHER PUBLICATIONS

Yun et al., "Uniplanar One-Dimensional Photonic-Bandgap Structures and Resonators", IEEE Trans. on Microwaves Theory & Techniques, vol. 49, No. 3, Mar. 2001, pp. 549-553.*

J.J. Lee: "Slotline Impedance" IEEE Transactions on Microwave Theory and Techniques, IEEE Inc., New York, US, vol. 39, No. 4, Apr. 1, 1991, pp. 666-672.

J. Svacina: "Dispersion Characteristics of Multilayered Slotlines—A Simple Approach", IEEE Transactions on Microwave Theory and Techniques, IEEE Inc. New York, US, vol. 47, No. 9, part 2, Sep. 1999, pp. 1826-1829.

(Continued)

*Primary Examiner* — Seungsook Ham
(74) *Attorney, Agent, or Firm* — Myers Wolin, LLC

(57) ABSTRACT

A microwave device of the slot-line type with a photonic band gap structure, including at least: a first substrate in a dielectric material having a first permittivity ∈r1, a second substrate in a dielectric material having a second permittivity ∈r2, and between the two substrates, a conductive layer in which at least one slot-line is engraved, with, on the face of the first and second substrates opposite the face in contact with the conductive layer, facing the slot-line, periodic metal patterns. A compact filtering structure is realized.

7 Claims, 3 Drawing Sheets

OTHER PUBLICATIONS

N. Boisbouvier et al: "Harmonic-less annular slot antenna (ASA) using a novel PBG structure for slot-line printed devices", IEEE Antennas and Propagation Society International Symposium, 2003 Digest, APS, Columbus, Ohio, Jun. 22-27, 2003, New York, NY USA, vol. vol. 4 of 4, Jun. 22, 2003. pp. 553-556.

Lijun Zhang et al: "Microstrip line fed slot antenna with PBG superstrate" Antennas and Propagation Society, 1999, IEEE International Symposium 1999 Orlando, FL, USA Jul. 11-16, 1999, Piscataway, NJ USA, IEEE, US, Jul. 11, 1999, pp. 1924-1927.

* cited by examiner

SLOT-LINE TYPE MICROWAVE DEVICE WITH A PHOTONIC BAND GAP STRUCTURE

This application claims the benefit, under 35 U.S.C. §365 of International Application PCT/FR05/050001, filed Jan. 3, 2005, which was published in accordance with PCT Article 21(2) on Jul. 21, 2005 in French and which claims the benefit of French patent application No. 0450036, filed Jan. 7, 2004.

The present invention relates to a new microwave device of the slot or slot based structure type (slot-line, wiggly slotline, etc.) comprising at least one photonic band gap structure (PBG)

BACKGROUND OF THE INVENTION

The photonic band gap structures (PBG) are periodic structures that prohibit wave propagation for certain frequency bandwidths. For several years, research and studies have been conducted to use these structures in frequency ranges such as those used on microwave devices.

A method for realizing a structure of this type was proposed by the applicant, particularly in the French patent application no. 02 12656 of 11 Oct. 2002 and in the article entitled "Harmonic-less Annular Slot Antenna (ASA) using a novel PBG structure for slot-line printed device" IEEE AP-S 2003. These documents thus describe a method for realizing a PBG structure on a microwave device of the slot-line type realized on a metallized substrate, together with antennas of the annular slot type or Vivaldi type antennas using such structures to perform a filtering or a frequency adaptation of the said antenna.

As shown in FIGS. 1A and 1B, such a microwave device comprises a substrate 1 of which one face 2 has been metallized. A slot line 3 is realized by engraving the metal layer.

As shown in FIGS. 1A and 1B, the substrate 1 has a height h and is realized in a known dielectric material such as the materials known under the denomination "Ro4003" or "FR4", the metal layer being realized preferably in copper or in any other conductive material.

In this case, the PBG structure is obtained by producing the patterns 4, namely patches, on the face of the substrate 1 opposite the face carrying the metal layer 2. The patterns or patches 4 are generally realized by engraving a metal layer and are found opposite the slot-line 3.

In a known manner, to obtain a photonic band gap structure, the patterns 4 repeat periodically and are spaced at a distance that gives the pattern repetition period. This distance sets the central frequency of the band gap when the patterns are identical. Hence, the distance is in the order of $k\lambda g/2$ where $\lambda g$ is the guided wavelength in the slot-line 3 at the central frequency of the photonic band gap and k is a positive integer greater than or equal to 1.

The pattern 4 can be of any shape. However, the equivalent surface of the pattern determines the width and/or depth of the band gap.

To implement the filtering phenomenon of such a device, a device of the type of the one shown in FIG. 1A in which the substrate is constituted by the "Rogers Ro4003" with relative permittivity $\in r=3.38$ and the metallizations are of copper of thickness 17.5 μm is simulated. In this case, the photonic band gap structure is composed of twelve metal discs 4 periodically spaced at a distance a=12.7 mm corresponding to the creation of a band gap centred at Fc(BI)=8.3 GHz, and the discs 4 have a radius r such that the ratio r/a=0.25.

As shown in FIG. 2, which gives the transmission S12 and reflection S11 coefficients according to the frequency, a band gap is obtained having a width of 900 MHz and centred on 8.25 GHz. In this case, the rejection of the central frequency 8.25 GHz is −17 dB.

SUMMARY OF THE INVENTION

The present invention relates to an improvement to the above structure. This improvement enables among other things the effect of the photonic band gap to be increased, by taking full advantage of the slot-line on which the PBG structure acts. Hence, for a constant size, the band gap rejection can be increased, or, for a constant rejection, the size of the structure can be reduced.

Moreover, the use of two different substrates offers a degree of extra freedom to adjust the rejection of the filter as well as the central frequency and width of the band gap.

The present invention thus relates to a microwave device of the slot-line type with a photonic band gap structure (PBG) characterized in that it comprises at least:

- a first substrate in a dielectric material having a first permittivity $\in r$1,
- a second substrate in a dielectric material having a second permittivity $\in r$2, and
- between the two substrates, a conductive layer in which at least one slot-line is engraved,
- with, on the face of the first and second substrates opposite the face in contact with the conductive layer, facing the slot-line, periodic metal patterns.

According to other characteristics of the present invention, the permittivities $\in r$1 and $\in r$2 of the first and second substrates can be equal or different. Moreover, the period between two metal patterns equals $k\lambda g/2$ where $\lambda g$ is the guided wavelength in the slot at the central frequency of the photonic band gap and k is a positive integer greater than or equal to 1. The periodic patterns also have an equivalent surface function of the width and depth of the band gap.

According to another characteristic of the invention, the period of the patterns realized on the first substrate is identical to the period of the patterns realized on the second substrate. Moreover, the periodic patterns realized on the first substrate are facing the patterns realized on the second substrate or, according to one variant, the patterns realized on the first substrate are offset with respect to the periodic patterns realized on the second substrate.

According to another characteristic of the present invention, the photonic band gap structure described above can be used with a slot-line engraved into the conductive layer, this slot-line having a width varying according to a periodic law. This form of slot-line is known under the name of "Wiggly-slotline". In general, this structure can be used with any slot-line based device (filter, etc.). In the case of a "wiggly" type slot-line, this invention can increase the filtering function.

Other characteristics and advantages of the present invention will emerge upon reading the description of different embodiments, this description being made with reference to the drawings attached in the appendix, in which:

DETAILED DESCRIPTION OF PREFERRED EMBODIMENTS

Figure 3A:
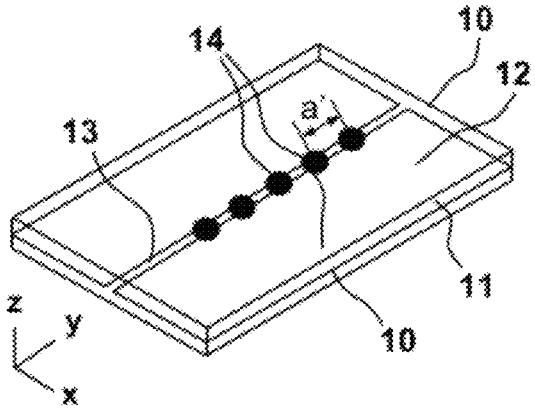
FIGS. 3A and 3B are respectively a diagrammatic perspective view and a cross-section view of a microwave device of the slot-line type comprising PBG structures in accordance with an embodiment of the present invention.
Figure 3B:
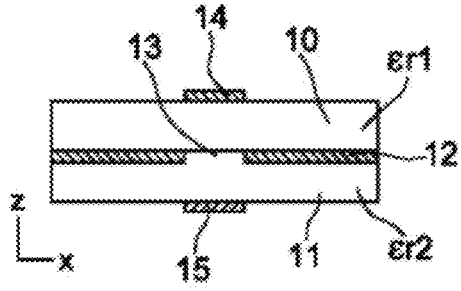

A first microwave device in accordance with the present invention is shown diagrammatically in FIGS. 3A and 3B. More specifically, this device comprises a first substrate 10 made of a dielectric material such as the Rogers Ro4003. This first substrate has a permittivity ∈r1.

In a known manner, one of the faces of the substrate 10 was covered with a conductive layer 12, more specifically with a metal layer such as a copper layer in which a slot-line 13 has been engraved.

As shown in the figures, in accordance with the present invention, a second substrate 11 in a dielectric material having a permittivity ∈r2 was deposited under the layer 12. In this case, the permittivities ∈r1 and ∈r2 of the two substrates can be identical or different. The use of a different permittivity provides an additional degree of freedom in the realization of the required filter in terms of rejection, width and central frequency of the band gap. The fact of using two different substrates modifies ∈eff considered by the line; now, this value occurs in the relationship that links the central frequency of the band gap to the size of the PBG structure.

$$a = \frac{\lambda 0}{2\sqrt{\varepsilon eff}} = \frac{C}{2f\sqrt{\varepsilon eff}}$$

Hence, for the same PBG size, if the permittivity is greater, then the band gap is offset toward the low frequencies.

In accordance with the present invention, on the structure described above was realized a first photonic band gap structure constituted by metal patterns 14 engraved on the face of the first substrate 10 opposite the face carrying the metal layer 12. The patterns 14 are constituted, in the embodiment shown, by patches in the form of discs, namely five metal patches. The patches 14 are spaced at a distance a' that gives the repetition period of the pattern. This distance sets the central frequency of the band gap when the patterns are identical. Hence, the distance a' between the patterns is in the order of k'λg/2 where λg is the guided wavelength in the slot-line 13 at the central frequency of the band gap chosen and k' is a positive integer greater than or equal to 1.

Moreover, as shown clearly in FIG. 3B, periodic metal patterns 15 were engraved on the face of the substrate 11 opposite the face in contact with the metal layer 12. This structure formed by the patterns 15 is, in this embodiment, identical to the structure formed by the patterns 14 and the patterns 14 and 15 are facing each other. In the photonic band gap structure of FIGS. 3A and 3B, identical patterns were realized on both sides of the slot 13, namely the space between the patterns 14 or 15 and the number of patterns was maintained. A device such as shown in FIGS. 3A and 3B was simulated by directly exciting the slot-line. Both of the substrates used are identical (Ro4003 with permittivity er=3.38 and height h=0.81 mm). The PBG patterns are also identical above and below the slot-line. (5 patches spaced at a'=12.7 mm and with a radius r'=3 mm).

Figure 1A:
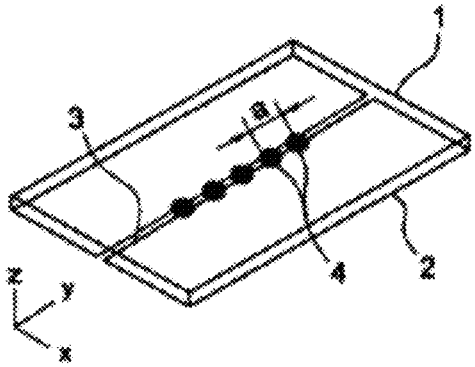
FIG.1A Prior Art
FIGS. 1A and 1B are respectively a diagrammatic perspective view and a cross-section view of a microwave device of the slot-line type comprising a photonic band gap structure according to the prior art.
Figure 1B:
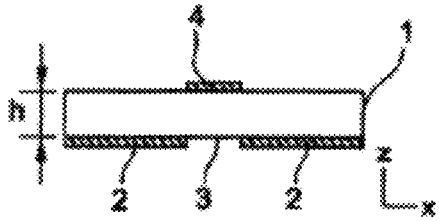
FIG.1B Prior Art
Figure 2:
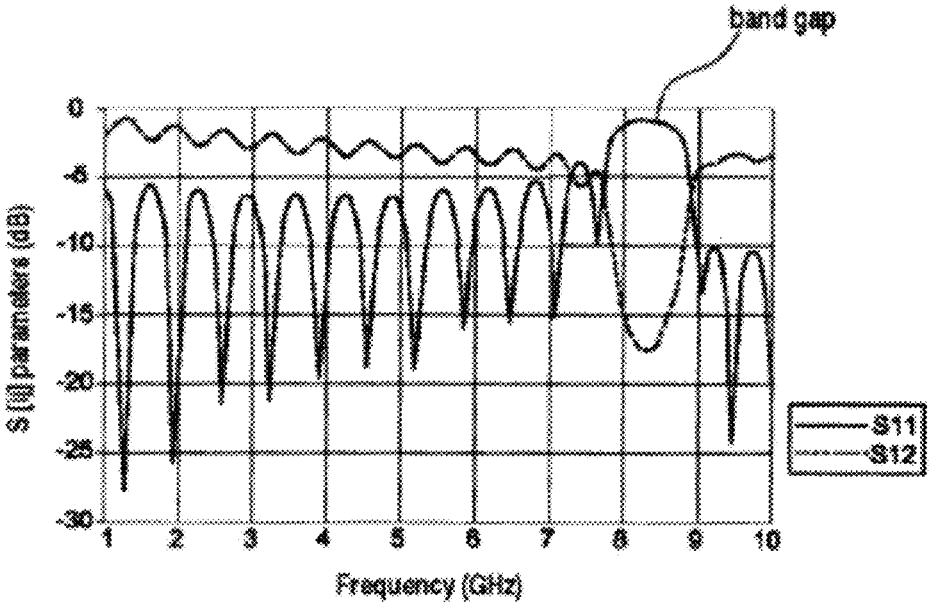
FIG.2 Prior Art
FIG. 2 shows the curves giving the parameters S according to the frequency, obtained by simulating a structure as shown in FIG. 1A.
Figure 4:
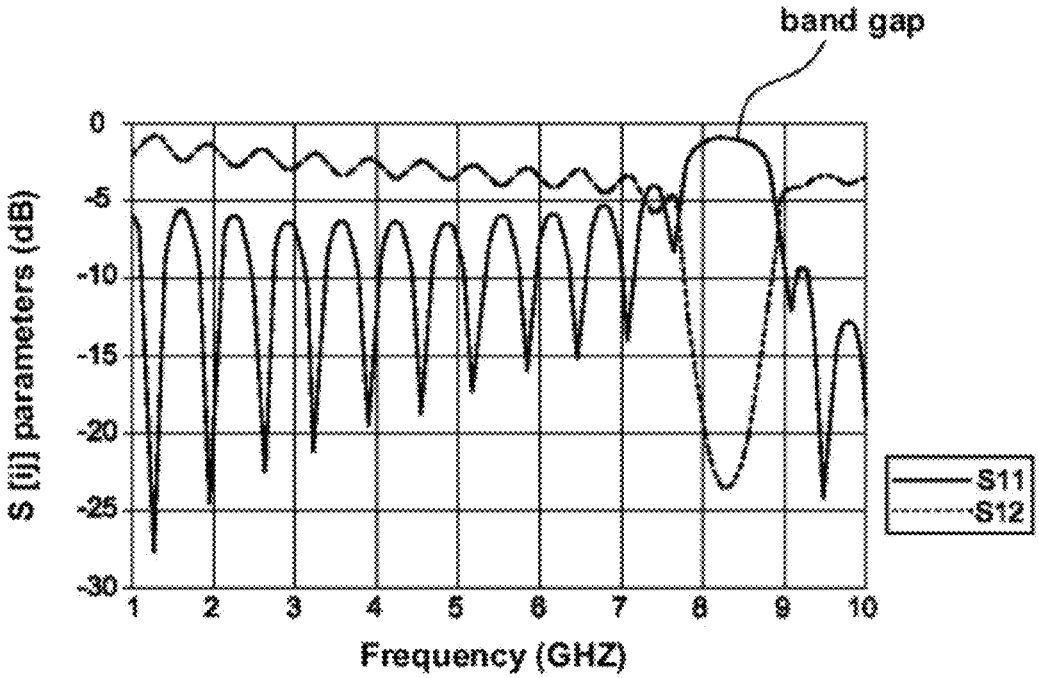
FIG. 4 shows the curves giving the parameters S according to the frequency of a simulated device such as the device in FIG. 3A.

In this case, the transmission and reflection parameters S are shown in FIG. 4. In this figure, the band gap has a width of 1.4 GHz and is centred at 8.3 GHz. This band is therefore larger than the band obtained with a device according to the FIGS. 1A and 1B. Moreover, the band gap rejection at the central frequency is thus −23 dB that is an increase of 6 dB in relation to the structure of the FIGS. 1A and 1B.

Figure 5:
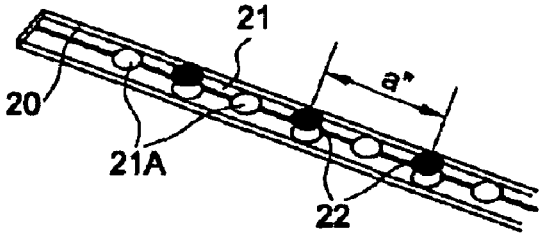
FIG. 5 is a diagrammatic perspective view of another embodiment of the present invention.

With reference to FIG. 5, another embodiment of the microwave device in accordance with the present invention will now be described.

In this case, the slot-line 21 realized in the metal layer 20 is constituted by a line presenting a periodically modulated bandwidth. In the present case, circles 21A spaced periodically on the line 21 constitute the modulations.

As for the embodiment of FIGS. 3A and 3B, a dielectric substrate is provided on each side of the metal layer. On the face of the substrate opposite the face carrying the layer 20, photonic band gap structures have been realized that are constituted by metal patches 22 spaced periodically facing the slot 21, according to a period a". This structure was simulated by using a value of 12.7 mm for the period a", this periodicity also being used for the circles 21*a*. For the simulation, the line also has twelve circles 21*a*.

Figure 6:
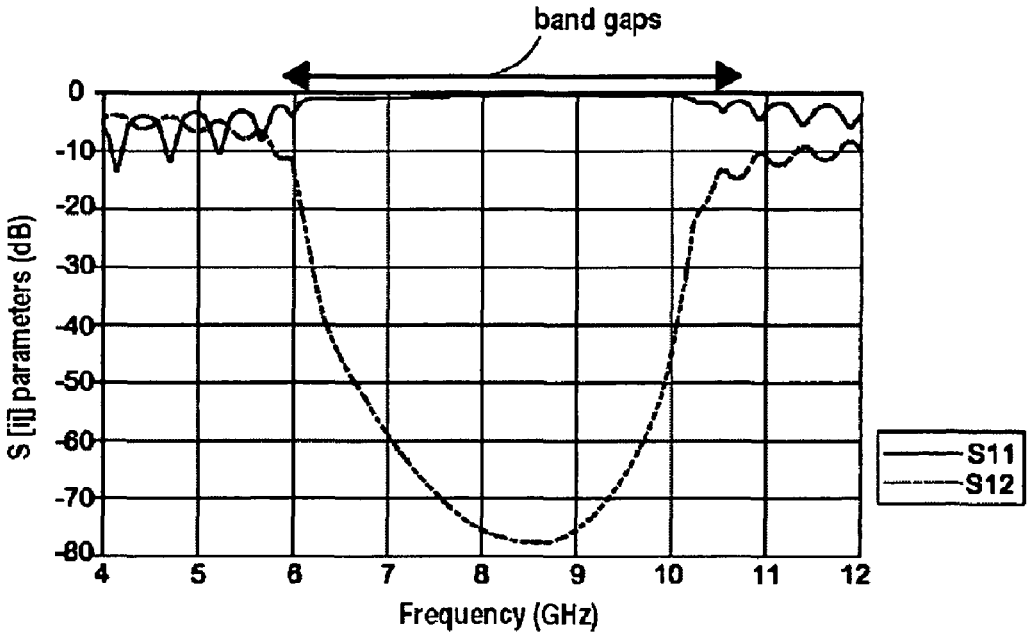
FIG. 6 shows the curves giving the parameters S according to the frequency, obtained by simulating a structure such as the structure shown in FIG. 5.

The results of the simulation are provided in FIG. 6. The parameters S are given according to the frequency. A band gap is thus obtained that is centred on 8.3 GHz and this band gap has a width of 5.2 GHz and shows a rejection at the central frequency of −78 dB.

Figure 7A:
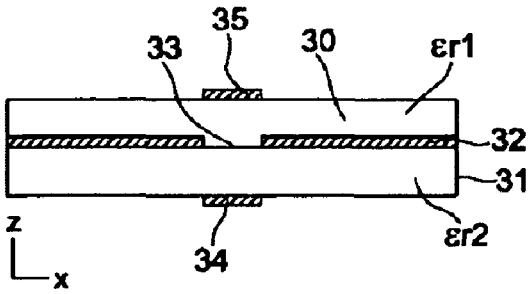
FIGS. 7A and 7B are cross-section views of another embodiment of a device in accordance with the present invention.
Figure 7B:
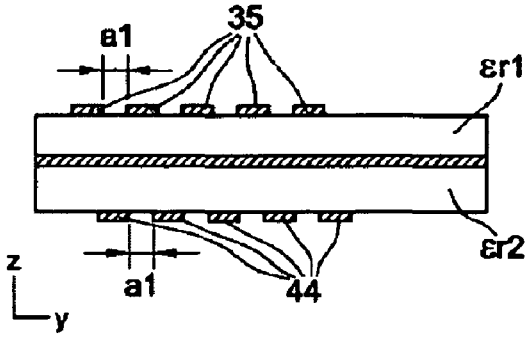

With reference to FIGS. 7A and 7B, another embodiment of the microwave device in accordance with the present invention will now be described.

In the case shown in FIGS. 7A and 7B, the device is constituted by two substrates 30, 31 made of a dielectric material showing respective permittivities of ∈r1 and ∈r2. Between the two substrates, a metal layer 32 is provided in which a slot-line 33 has been engraved. The photonic band gap structures 34 and 35 were realized on the faces opposite the face in contact with the layer 32.

As shown in FIG. 7B, the photonic band gap structure 35 is constituted by patterns spaced at a distance of $a_1$ from each other, which gives the periodicity of the patterns. Moreover, the patterns 34 themselves also have a periodicity $a_1$ but they are not facing the patterns 35. The patterns are actually offset above and below the slot-line.

As the additional simulations show, the effect obtained is fairly complex. For example, offsetting the metal patches can be considered as a modification of the shape/surface of the elementary cell, particularly when the patches above and below the slot-line are partially overlapping. This is why the offset between the metal patches above and below the slot-line provide an additional degree of freedom, whether this is with identical or different substrates.

The present invention was described with reference to disc-shaped patterns. However, the invention also applies to patterns of any shape, given that the equivalent surface of the pattern determines the width and/or depth of the band gap.

The present invention is applicable particularly to:

increase the filtering on a slot type structure.

make the filtering structure more compact.

provide an additional degree of freedom in the design of the band gaps.

The invention claimed is:

1. A microwave device of the slot-line type with a photonic band gap structure, comprising:

a first substrate in a dielectric material having a first permittivity $\in r1$, a second substrate in a dielectric material having a second permittivity $\in r2$, different from the first permittivity $\in r1$, and between the first and second substrates, a conductive layer in which at least one slot-line is engraved, with, first periodic metal patterns realized on the face of the first substrate opposite the face of the first substrate in contact with the conductive layer, and second periodic metal patterns realized on the face of the second substrate opposite the face of the second substrate in contact with the conductive layer, said first and second periodic metal patterns facing the at least one slot-line to realize said photonic band gap structure.

2. The device according to claim 1, wherein two consecutive metal patterns have a period equal to $k\lambda g/2$ where $\lambda g$ is the guided wavelength in the slot at the central frequency of the photonic band gap and k is a positive integer greater than or equal to 1.

3. The device according to claim 1, wherein the periodic metal patterns have a surface determined by the width and depth of the band gap.

4. The device according to claim 1, wherein the first periodic metal patterns realized on the first substrate have a period identical to the period of the second periodic metal patterns realized on the second substrate.

5. The device according to claim 1, wherein the first periodic metal patterns realized on the first substrate are facing the second periodic metal patterns realized on the second substrate.

6. The device according to claim 1, wherein the first periodic metal patterns realized on the first substrate are offset in relation to the second periodic metal patterns realized on the second substrate.

7. The device according to claim 1, wherein the slot-line engraved in the conductive layer has a width periodically modulated.

* * * * *